US010665194B1

(12) United States Patent
Xu

(10) Patent No.: US 10,665,194 B1
(45) Date of Patent: May 26, 2020

(54) LIQUID CRYSTAL DISPLAY DEVICE AND DRIVING METHOD THEREOF

(71) Applicant: SHENZHEN CHINA STAR OPTOELECTRONICS TECHNOLOGY CO., LTD., Shenzhen, Guangdong (CN)

(72) Inventor: Xiangyang Xu, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 143 days.

(21) Appl. No.: 16/087,714

(22) PCT Filed: Sep. 7, 2018

(86) PCT No.: PCT/CN2018/104509
§ 371 (c)(1),
(2) Date: Sep. 24, 2018

(87) PCT Pub. No.: WO2019/200820
PCT Pub. Date: Oct. 24, 2019

(30) Foreign Application Priority Data

Apr. 19, 2018 (CN) ..... 2018 1 0356590

(51) Int. Cl.
*G09G 3/36* (2006.01)

(52) U.S. Cl.
CPC ..... *G09G 3/3677* (2013.01); *G09G 3/3688* (2013.01); *G09G 2320/041* (2013.01)

(58) Field of Classification Search
CPC ..... G09G 3/36; G09G 3/3611; G09G 3/3648; G09G 3/3677; G09G 3/3688; G09G 2320/041
See application file for complete search history.

(56) References Cited

U.S. PATENT DOCUMENTS

2008/0170064 A1* 7/2008 Lee ..... G09G 3/3677 345/214
2008/0266477 A1* 10/2008 Lee ..... G09G 3/3677 349/46

(Continued)

FOREIGN PATENT DOCUMENTS

CN 101350185 A 1/2009
CN 102222488 A * 10/2011

(Continued)

*Primary Examiner* — David Tung
(74) *Attorney, Agent, or Firm* — Leong C. Lei

(57) ABSTRACT

Provided are a liquid crystal display device and a driving method thereof. A first GOA circuit and a second GOA circuit are provided, and channel widths of thin film transistors in the first GOA circuit are greater than channel widths of thin film transistors in the second GOA circuit. When the ambient temperature is too high, the start signal and the clock signal are only outputted to the second GOA circuit to provide the scan signals. When the ambient temperature is too low, the start signal and the clock signal are only outputted to the first GOA circuit to provide the scan signals to the plurality of scan lines. When the ambient temperature is normal, the start signal and the clock signal are outputted to the first GOA circuit and the second GOA circuit to provide the scan signals to the plurality of scan lines at the same time.

10 Claims, 5 Drawing Sheets

(56) References Cited

U.S. PATENT DOCUMENTS

| | | | | |
|---|---|---|---|---|
| 2009/0267883 | A1* | 10/2009 | Kim | G09G 3/3677 345/94 |
| 2009/0284515 | A1 | 11/2009 | Tsuge | |
| 2010/0002021 | A1* | 1/2010 | Hashimoto | G09G 3/2003 345/690 |
| 2012/0062528 | A1* | 3/2012 | Kimura | G09G 3/3648 345/204 |
| 2012/0098815 | A1* | 4/2012 | Hou | G09G 3/3677 345/212 |
| 2012/0249619 | A1* | 10/2012 | Furukawa | G09G 3/3648 345/691 |
| 2014/0111499 | A1* | 4/2014 | Jang | G09G 3/3696 345/212 |
| 2018/0059470 | A1* | 3/2018 | Nam | G02F 1/1368 |
| 2019/0057668 | A1* | 2/2019 | Xiong | G09G 3/3696 |

FOREIGN PATENT DOCUMENTS

| | | | | |
|---|---|---|---|---|
| CN | 102222488 | A | | 10/2011 |
| CN | 106531100 | A | * | 3/2017 |
| CN | 106531100 | A | | 3/2017 |
| CN | 107369426 | A | | 11/2017 |
| CN | 107424575 | A | | 12/2017 |
| CN | 107492362 | A | | 12/2017 |

* cited by examiner

LIQUID CRYSTAL DISPLAY DEVICE AND DRIVING METHOD THEREOF

RELATED APPLICATIONS

The present application is a National Phase of International Application Number PCT/CN2018/104509, filed Sep. 7, 2018, and claims the priority of China Application No. 201810356590.X, filed Apr. 19, 2018.

FIELD OF THE INVENTION

The present invention relates to a display technology field, and more particularly to a liquid crystal display device and a driving method thereof.

BACKGROUND OF THE INVENTION

The Liquid Crystal Display (LCD) possesses advantages of thin body, power saving and no radiation to be widely used in many application scope, such as LCD TV, mobile phone, personal digital assistant (PDA), digital camera, notebook, laptop, and dominates the flat panel display field.

Most of the liquid crystal displays on the present market are backlight type liquid crystal displays, which comprise a liquid crystal display panel and a backlight module. The working principle of the liquid crystal display panel is that the Liquid Crystal is injected between the Thin Film Transistor Array Substrate (TFT array substrate) and the Color Filter (CF). The light of backlight module is refracted to generate images by applying driving voltages to the two substrates for controlling the rotations of the liquid crystal molecules.

In the active liquid crystal display, each pixel is electrically coupled to a thin film transistor (TFT), and the gate of the thin film transistor is coupled to a level scan line, and the drain is coupled to a vertical data line, and the source is coupled to the pixel electrode. The enough voltage is applied to the level scan line, and all the TFTs electrically coupled to the horizontal scan line are activated. Thus, the signal voltage on the data line can be written into the pixel to control the transmittances of different liquid crystals to achieve the effect of controlling colors and brightness. The driving of the level scan line in the present active liquid crystal display is mainly accomplished by the external Integrated Circuit (IC). The external IC can control the charge and discharge stage by stage of the level scan lines of respective stages.

The GOA (Gate Driver on Array) technology, i.e. the array substrate row driving technology can utilize the array manufacture process of the liquid crystal display panel to manufacture the gate driving circuit on the TFT array substrate for realizing the driving way of scanning the gates row by row. The GOA technology can reduce the bonding procedure of the external IC and has potential to raise the productivity and lower the production cost. Meanwhile, it can make the liquid crystal display panel more suitable to the narrow frame or non frame design of display products. The GOA circuit of prior art generally comprises GOA units of multiple stages to output scan signals to the plurality of rows of scan lines. The GOA unit of each stage comprises a plurality of thin film transistors. The electrical properties of thin film transistors are very dependent on the temperature of the operating environment. Under a low temperature condition (below −50 degrees Celsius), the current flowing through the TFTs will become smaller, resulting in insufficient driving. Under a high temperature environment (above 80 degrees Celsius), the current flowing through the TFT increases, and the leakage current increases and the output of the GOA circuit becomes abnormal. In the current GOA circuit design, it is necessary to take into consideration both the high and low temperature margins of thin film transistors. However, in the prior art, in order to increase the high temperature margin of the thin film transistors, the conventional method is to reduce the channel width of the thin film transistors and in order to decrease the low temperature margin of the thin film transistors, the conventional method is to enlarge the channel width of the thin film transistors. The two are opposite, so the operating temperature range of the existing GOA circuit is very limited.

SUMMARY OF THE INVENTION

An objective of the present invention is to provide a liquid crystal display device having a wide operating temperature range and high product quality.

Another objective of the present invention is to provide a driving method of a liquid crystal display device capable of expanding an operating temperature range and promoting product quality.

For realizing the aforesaid objectives, the present invention first provides a liquid crystal display device, comprising a liquid crystal panel, a controlling circuit electrically coupled to the liquid crystal panel, a temperature sensing circuit electrically coupled to the controlling circuit and a timing controller electrically coupled to the controlling circuit;

wherein the liquid crystal panel comprises a plurality of sub pixels arranged in an array, a plurality of scan lines respectively coupled to a plurality of rows of sub pixels, and a first GOA (gate driver on array) circuit and a second GOA (gate driver on array) circuit respectively disposed on both sides of the sub pixels in an array; one end of each scan line is electrically coupled to the first GOA circuit, and the other end is electrically coupled to the second GOA circuit; each of the first GOA circuit and the second GOA circuit comprises a plurality of thin film transistors, and a channel width of the thin film transistors in the first GOA circuit is greater than a channel width of the thin film transistors in the second GOA circuit;

the temperature sensing circuit is used to sense an ambient temperature of the liquid crystal display device and transmit a sensing result to the controlling circuit;

the timing controller is used to output a start signal and a clock signal to the controlling circuit;

a first temperature and a second temperature is predetermined, and the first temperature is higher than the second temperature, and the controlling circuit is used to only output the start signal and the clock signal transmitted by the timing controller to the second GOA circuit to control the second GOA circuit to provide scan signals to the plurality of scan lines when the ambient temperature of the liquid crystal display device is greater than or equal to the first temperature, and to only output the start signal and the clock signal transmitted by the timing controller to the first GOA circuit to control the first GOA circuit to provide scan signals to the plurality of scan lines when the ambient temperature of the liquid crystal display device is less than or equal to the second temperature, and to output the start signal and the clock signal transmitted by the timing controller to the first GOA circuit and the second GOA circuit to control the first GOA circuit and the second GOA circuit to provide scan signals to the plurality of scan lines at the same time when the ambient temperature of the liquid crystal display device is greater than the second temperature and less than the first temperature.

The first GOA circuit and the second GOA circuit each comprises GOA units of a plurality of stages which are cascade coupled, and the GOA unit of each stage in the first GOA circuit and the second GOA circuit comprises a pull-up controlling circuit, a pull-up circuit, a pull-down circuit, first pull-down maintaining circuit and a second pull-down maintaining circuit;

n is set to be a positive integer in the GOA unit of the nth stage in the first GOA circuit and the second GOA circuit except for the GOA units of the first stage and the GOA units of the last stage in the first GOA circuit and the second GOA circuit:

the pull-up controlling circuit comprises a first thin film transistor; a gate of the first thin film transistor receives a stage transfer signal of the GOA unit of the n−1th stage, and a source of the first thin film transistor is electrically coupled to an output end of the GOA unit of the n−1th stage, and a drain of the first thin film transistor is electrically coupled to a first node;

the pull-up circuit comprises a second thin film transistor, a third thin film transistor and a capacitor; a gate of the second thin film transistor is electrically coupled to the first node, and a source of the second thin film transistor is electrically coupled to a source of the third thin film transistor and is coupled to a clock signal input end of the GOA unit of the nth stage, and a drain of the second thin film transistor is coupled to an output end of the GOA unit of the nth stage coupled to the nth scan line; a gate of the third thin film transistor is electrically coupled to the first node, and a drain of the third thin film transistor outputs the stage transfer signal; one end of the capacitor is electrically coupled to the first node, and the other end of the capacitor is electrically coupled to the drain of the second thin film transistor;

the pull-down circuit comprises a fourth thin film transistor and a fifth thin film transistor; a gate of the fourth thin film transistor is electrically coupled to an output end of the GOA unit of the n+1th stage, and a source of the fourth thin film transistor is electrically coupled to the drain of the second thin film transistor, and a drain of the fourth thin film transistor receives a constant low voltage level; a gate of the fifth thin film transistor is electrically coupled to the gate of the fourth thin film transistor, and the source of the fifth thin film transistor is electrically coupled to the first node, and a drain of the fifth thin film transistor receives the constant low voltage level;

the first pull-down maintaining circuit comprises a sixth thin film transistor, a seventh thin film transistor, an eighth thin film transistor, a ninth thin film transistor, a tenth thin film transistor and an eleventh thin film transistor; a gate of the sixth thin film transistor is coupled to a second node, and a source of the sixth thin film transistor is electrically coupled to the drain of the second thin film transistor, and a drain of the sixth thin film transistor receives the constant low voltage level; a gate of the seventh thin film transistor is electrically coupled to the second node, and a source of the seventh thin film transistor is electrically coupled to the first node, and a drain of the seventh thin film transistor receives the constant low voltage level; a gate and a source of the eighth thin film transistor both receive a first low frequency control signal, and a drain of the eighth thin film transistor is electrically coupled to a gate of the tenth thin film transistor; a gate of the ninth thin film transistor is electrically coupled to the first node, and a source of the ninth thin film transistor is electrically coupled to the gate of the tenth thin film transistor, and a drain of the ninth thin film transistor receives the constant low voltage level; a source of the tenth thin film transistor receives the first low frequency control signal, and a drain of the tenth thin film transistor is electrically coupled to the second node; a gate of the eleventh thin film transistor is electrically coupled to the first node, and a source of the eleventh thin film transistor is electrically coupled to the second node, and a drain of the eleventh thin film transistor receives the constant low voltage level;

the second pull-down maintaining circuit comprises a twelfth thin film transistor, a thirteenth thin film transistor, a fourteenth thin film transistor, a fifteenth thin film transistor, a sixteenth thin film transistor and a seventeenth thin film transistor; a gate of the twelfth thin film transistor is electrically coupled to a third node, and a source of the twelfth thin film transistor is electrically coupled to the drain of the second thin film transistor, and a drain of the twelfth thin film transistor receives the constant low voltage level; a gate of the thirteenth thin film transistor is electrically coupled to the third node, and a source of the thirteenth thin film transistor is electrically coupled to the first node, and a drain of the thirteenth thin film transistor receives the constant low voltage level; a gate and a source of the fourteenth thin film transistor are both receive a second low frequency control signal, and a drain of the fourteenth thin film transistor is electrically coupled to a gate of the sixteenth thin film transistor; a gate of the fifteenth thin film transistor is electrically coupled to the first node, and a source of the fifteenth thin film transistor is electrically coupled to the gate of the sixteenth thin film transistor, and a drain of the fifteenth thin film transistor receives the constant low voltage level; a source of sixteenth thin film transistor receives the second low frequency control signal, and a drain of sixteenth thin film transistor is electrically coupled to the third node; a gate of the seventeenth thin film transistor is electrically coupled to the first node, and a source of the seventeenth thin film transistor is electrically coupled to the third node, and a drain of the seventeenth thin film transistor receives the constant low voltage level;

the first low frequency control signal and the second low frequency control signal are both pulse signals, and the first low frequency control signal and the second low frequency control signal both have a duty ratio of 0.5, and the first low frequency control signal and the second low frequency signal have opposite phases;

a gate and a source of a first thin film transistor of the GOA unit of the first stage are electrically coupled to a gate of the fourth thin film transistor and a gate of the fifth thin film transistor of the GOA unit of the last stage in the first GOA circuit;

a gate and a source of a first thin film transistor of the GOA unit of the first stage are electrically coupled to a gate of the fourth thin film transistor and a gate of the fifth thin film transistor of the GOA unit of the last stage in the second GOA circuit;

the controlling circuit has two start signal output ends and four clock signal output ends; one of the two start signal output ends of the controlling circuit is electrically coupled to the gate of the first thin film transistor of the first GOA unit of the first stage in the first GOA circuit, and the other of the two start signal output ends is electrically coupled to the gate of the first thin film transistor of the GOA unit of the first stage in the second GOA circuit; the four clock signal output ends of the control circuit are respectively electrically coupled to clock signal input ends of the GOA units of all odd stages in the first GOA circuit, clock signal input ends of the GOA units of all odd stages in the second GOA circuit, clock signal input ends of the GOA units of all even stages in the first GOA circuit and clock signal input ends of the GOA units of all even stages in the second GOA circuit.

The clock signal comprises a first clock signal and a second clock signal; the first clock signal and the second clock signal are both pulse signals, and the first clock signal and the second clock signal both have a duty ratio of 0.5, and the first clock signal and the second clock signal have opposite phases.

As the ambient temperature of the liquid crystal display device is greater than or equal to the first temperature, the start signal output end of the controlling circuit electrically coupled to the gate of the first thin film transistor of the GOA unit of the first stage in the second GOA circuit outputs the start signal, and the clock signal output end of the controlling circuit electrically coupled to the clock signal input ends of GOA units of all odd stages in the second GOA circuit outputs the first clock signal, and the clock signal output end of the controlling circuit electrically coupled to the clock signal input ends of GOA units of all even stages in the second GOA circuit outputs the second clock signal to control the second GOA circuit to output the scan signal to the plurality of scan lines;

as the ambient temperature of the liquid crystal display device is less than or equal to the second temperature, the start signal output end of the controlling circuit electrically coupled to the gate of the first thin film transistor of the GOA unit of the first stage in the first GOA circuit outputs the start signal, and the clock signal output end of the controlling circuit electrically coupled to the clock signal input ends of GOA units of all odd stages in the first GOA circuit outputs the first clock signal, and the clock signal output end of the controlling circuit electrically coupled to the clock signal input ends of GOA units of all even stages in the first GOA circuit outputs the second clock signal to control the first GOA circuit to output the scan signal to the plurality of scan lines;

as the ambient temperature of the liquid crystal display device is less than the first temperature and greater than the second temperature, the start signal output end of the controlling circuit electrically coupled to the gate of the first thin film transistor of the GOA unit of the first stage in the second GOA circuit outputs the start signal, and the clock signal output end of the controlling circuit electrically coupled to the clock signal input ends of GOA units of all odd stages in the second GOA circuit outputs the first clock signal, and the clock signal output end of the controlling circuit electrically coupled to the clock signal input ends of GOA units of all even stages in the second GOA circuit outputs the second clock signal; the start signal output end of the controlling circuit electrically coupled to the gate of the first thin film transistor of the GOA unit of the first stage in the first GOA circuit outputs the start signal, and the clock signal output end of the controlling circuit electrically coupled to the clock signal input ends of GOA units of all odd stages in the first GOA circuit outputs the first clock signal, and the clock signal output end of the controlling circuit electrically coupled to the clock signal input ends of GOA units of all even stages in the first GOA circuit outputs the second clock signal to control the first GOA circuit and the second GOA circuit to output the scan signals to the plurality of scan lines.

The channel width of anyone of the first thin film transistor, the second thin film transistor, the third thin film transistor, the fourth thin film transistor, the fifth thin film transistor, the sixth thin film transistor, the seventh thin film transistor, an eighth thin film transistor, the ninth thin film transistor, the tenth thin film transistor, An eleventh thin film transistor, the twelfth thin film transistor, the thirteenth thin film transistor, the fourteenth thin film transistor, the fifteenth thin film transistor, the sixteenth thin film transistor and the seventeenth thin film transistor in the first GOA circuit is greater than the channel width of anyone of the first thin film transistor, the second thin film transistor, the third thin film transistor, the fourth thin film transistor, the fifth thin film transistor, the sixth thin film transistor, the seventh thin film transistor, an eighth thin film transistor, the ninth thin film transistor, the tenth thin film transistor, An eleventh thin film transistor, the twelfth thin film transistor, the thirteenth thin film transistor, the fourteenth thin film transistor, the fifteenth thin film transistor, the sixteenth thin film transistor and the seventeenth thin film transistor in the second GOA circuit.

The first temperature is 75 degrees Celsius to 85 degrees Celsius; the second temperature is −35 degrees Celsius to −45 degrees Celsius.

The liquid crystal panel further comprises a plurality of data lines respectively coupled to the plurality of columns of sub pixels.

The liquid crystal panel comprises a display area and a border area outside the display area;

the plurality of sub pixels are all disposed in the display area, and the first GOA circuit and the second GOA circuit are both disposed in the border area.

The temperature sensing circuit is a temperature sensor.

The present invention further provides a driving method, applied to the aforesaid liquid crystal display device, comprising:

the temperature sensing circuit sensing the ambient temperature of the liquid crystal display device and transmitting the sensing result to the controlling circuit;

the timing controller outputting the start signal and the clock signal to the controlling circuit;

the controlling circuit only outputting the start signal and the clock signal transmitted by the timing controller to the second GOA circuit to control the second GOA circuit to provide the scan signals to the plurality of scan lines when the ambient temperature of the liquid crystal display device is greater than or equal to the first temperature;

the controlling circuit only outputting the start signal and the clock signal transmitted by the timing controller to the first GOA circuit to control the first GOA circuit to provide the scan signals to the plurality of scan lines when the ambient temperature of the liquid crystal display device is less than or equal to the second temperature;

the controlling circuit outputting the start signal and the clock signal transmitted by the timing controller to the first GOA circuit and the second GOA circuit to control the first GOA circuit and the second GOA circuit to provide the scan signals to the plurality of scan lines at the same time when the ambient temperature of the liquid crystal display device is greater than the second temperature and less than the first temperature.

The benefits of the present invention are: the first GOA circuit and the second GOA circuit are disposed on the liquid crystal panel in the liquid crystal display device provided by the present invention, and the channel widths of the thin film transistors in the first GOA circuit are greater than the channel widths of the thin film transistors in the second GOA circuit. During operation, when the ambient temperature is too high, the controlling circuit only outputs the start signal and the clock signal to the second GOA circuit to control the second GOA circuit to provide the scan signals to the plurality of scan lines. When the ambient temperature is too low, the controlling circuit only outputs the start signal and the clock signal to the first GOA circuit to control the first GOA circuit to provide the scan signals to the plurality of scan lines. When the ambient temperature is normal, the controlling circuit outputs the start signal and the clock signal to the first GOA circuit and the second GOA circuit to control the first GOA circuit and the second GOA circuit provide the scan signals to the plurality of scan lines at the same time, thereby effectively increasing the operating temperature range of the liquid crystal display device and improving the product quality. The driving method of the liquid crystal display device provided by the present invention is capable of expanding an operating temperature range and promoting product quality.

BRIEF DESCRIPTION OF THE DRAWINGS

In order to better understand the characteristics and technical aspect of the invention, please refer to the following detailed description and accompanying drawings of the present invention. However, the drawings are provided for reference only and are not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
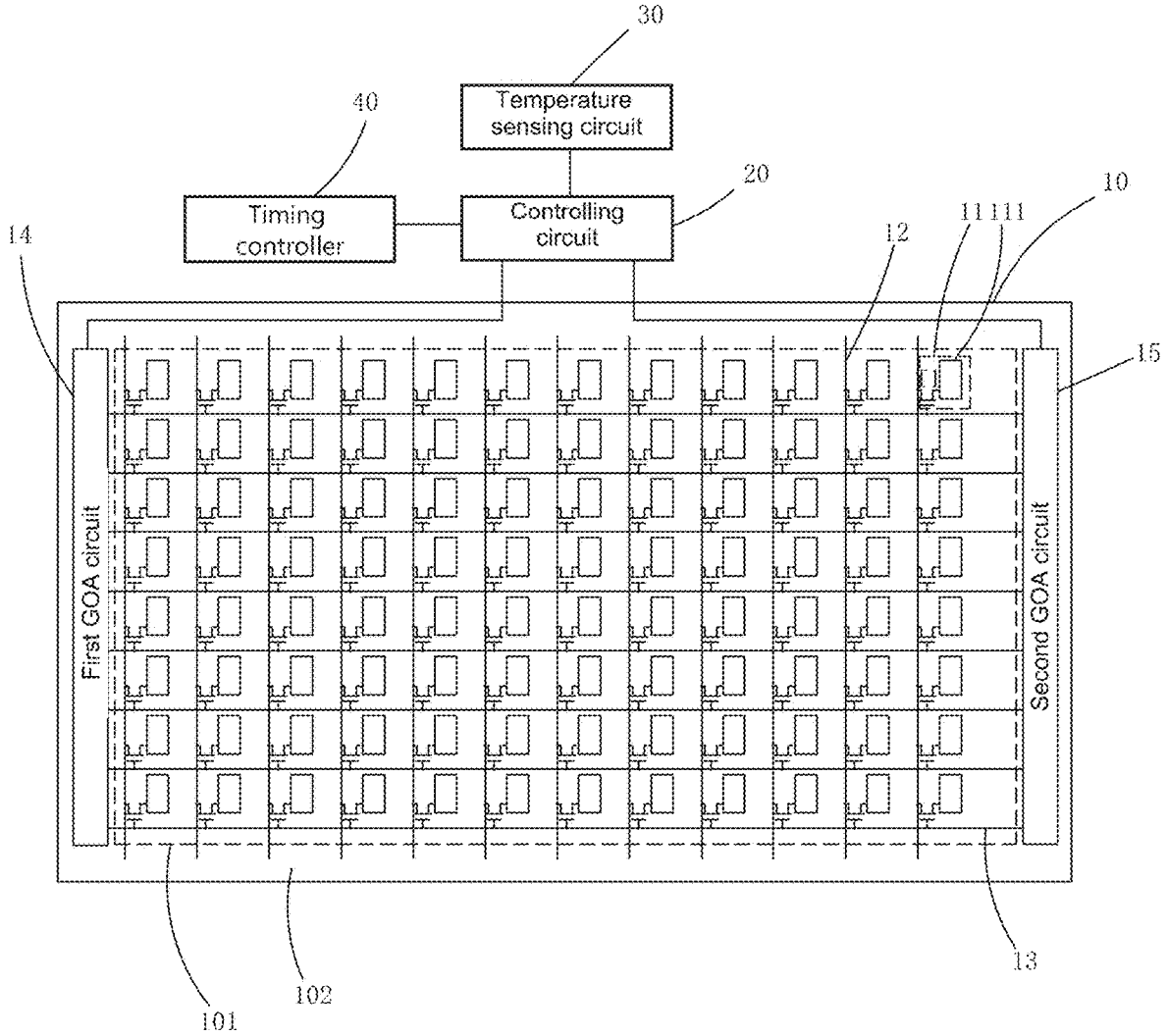
FIG. 1 is a structure diagram of a liquid crystal display device according to the present invention.

Please refer to FIG. 1. The present invention provides a liquid crystal display device, comprising a liquid crystal panel 10, a controlling circuit 20 electrically coupled to the liquid crystal panel 10, a temperature sensing circuit 30 electrically coupled to the controlling circuit 20 and a timing controller 40 electrically coupled to the controlling circuit 20.

The liquid crystal panel 10 comprises a plurality of sub pixels 11 arranged in an array, a plurality of data lines 12 respectively coupled to a plurality of columns of sub pixels 11, a plurality of scan lines 13 respectively coupled to a plurality of rows of sub pixels 11, and a first GOA (gate driver on array) circuit 14 and a second GOA (gate driver on array) circuit 15 respectively disposed on both sides of the sub pixels 11 in an array. One end of each scan line 13 is electrically coupled to the first GOA circuit 14, and the other end is electrically coupled to the second GOA circuit 15.

Each of the first GOA circuit 14 and the second GOA circuit 15 comprises a plurality of thin film transistors, and a channel width of the thin film transistors in the first GOA circuit 14 is greater than a channel width of the thin film transistors in the second GOA circuit 15.

The temperature sensing circuit 30 is used to sense an ambient temperature of the liquid crystal display device and transmit a sensing result to the controlling circuit 20. The timing controller 40 is used to output a start signal STV and a clock signal to the controlling circuit 20. A first temperature and a second temperature is predetermined, and the first temperature is higher than the second temperature, and the controlling circuit 20 is used to only output the start signal STV and the clock signal transmitted by the timing controller 40 to the second GOA circuit 15 to control the second GOA circuit 15 to provide scan signals to the plurality of scan lines 13 when the ambient temperature of the liquid crystal display device is greater than or equal to the first temperature, and to only output the start signal STV and the clock signal transmitted by the timing controller 40 to the first GOA circuit 14 to control the first GOA circuit 14 to provide scan signals to the plurality of scan lines 13 when the ambient temperature of the liquid crystal display device is less than or equal to the second temperature, and to output the start signal STV and the clock signal transmitted by the timing controller 40 to the first GOA circuit 14 and the second GOA circuit 15 to control the first GOA circuit 14 and the second GOA circuit 15 to provide scan signals to the plurality of scan lines 13 at the same time when the ambient temperature of the liquid crystal display device is greater than the second temperature and less than the first temperature.

Specifically, in the liquid crystal display device of the present invention, the first GOA circuit 14 and the second GOA circuit 15 is arranged on the liquid crystal panel, and the channel width of the thin film transistor in the first GOA circuit 14 is greater than the channel width of the thin film transistor in the second GOA circuit 15. Thus, the operating temperature limit of the thin film transistor in the first GOA circuit 14 is lower, and the operating temperature limit of the thin film transistor in the second GOA circuit 15 is higher. During operation, the temperature sensing circuit 30 is used to sense the ambient temperature of the liquid crystal display device. When the ambient temperature is greater than the first temperature, it indicates that the liquid crystal display device needs to enter a high temperature operation mode at this time, and the leakage current needs to be reduced. Then, the controlling circuit 20 only outputs the start signal STV and the clock signal to the second GOA circuit 15 to control the second GOA circuit 15 to provide the scan signals to the plurality of scan lines 13, and the first GOA circuit 14 does not work. Since the channel width of the thin film transistors in the second GOA circuit 15 is less than the channel width of the thin film transistors in the first GOA circuit 14, by designing the first temperature and the channel width of the thin film transistors in the second GOA circuit 15, the leakage current of the thin film transistors in the second GOA circuit 15 can be prevented at this time, so as to ensure that the output of the second GOA circuit 15 is normal. When the ambient temperature of the liquid crystal display device is less than the second temperature, it indicates that the liquid crystal display device needs to enter a low temperature operation mode at this time, and the driving ability is required to be enhanced. Then, the controlling circuit 20 only outputs the start signal STV and the clock signal to the first GOA circuit 14 to control the first GOA circuit 14 to provide the scan signals to the plurality of scan lines 13, and the second GOA circuit 15 does not work. Since the channel width of the thin film transistors in the first GOA circuit 14 is less than the channel width of the thin film transistors in the second GOA circuit 15, by designing the second temperature and the channel width of the thin film transistors in the first GOA circuit 14, the driving ability of the thin film transistors in the first GOA circuit 14 can be enhanced at this time. When the ambient temperature of the liquid crystal display device is less than the first temperature and greater than the second temperature, it indicates that the ambient temperature of the liquid crystal display device is normal. Then, the controlling circuit 20 only outputs the start signal STV and the clock signal to the first GOA circuit 14 and the second GOA circuit 15 to control the first GOA circuit 14 and the second GOA circuit 15 to provide the scan signals to the plurality of scan lines 13 at the same time for implementing the double side driving to the plurality of scan lines 13. The aforesaid liquid crystal display device is capable of expanding the operating temperature range and effectively promoting product quality.

Specifically, referring to FIG. 1, each sub pixel 11 comprises a switch thin film transistor T1 and a pixel electrode 111. A gate of the switch thin film transistor T1 is electrically coupled to the scan line 13, which is coupled to the sub pixel 11. A source of the switch thin film transistor is electrically coupled to the data line 12, which is coupled to the sub pixel 11. A drain of the switch thin film transistor is electrically coupled to the pixel electrode 111.

Specifically, the first temperature is 75 degrees Celsius to 85 degrees Celsius, and is preferably to be 80 degrees Celsius. The second temperature is −35 degrees Celsius to −45 degrees Celsius, and is preferably to be −40 degrees Celsius.

Specifically, the liquid crystal panel 10 comprises a display area 101 and a border area 102 outside the display area 101. The plurality of sub pixels 11 are all disposed in the display area 101, and the first GOA circuit 14 and the second GOA circuit 15 are both disposed in the border area 102.

Preferably, the temperature sensing circuit 30 is a temperature sensor.

Specifically, the structures of the first GOA circuit 14 and the second GOA circuit 15 can adopt the structure of any GOA circuit commonly used in the prior art, and will not affect the implementation of the present invention.

Figure 2:
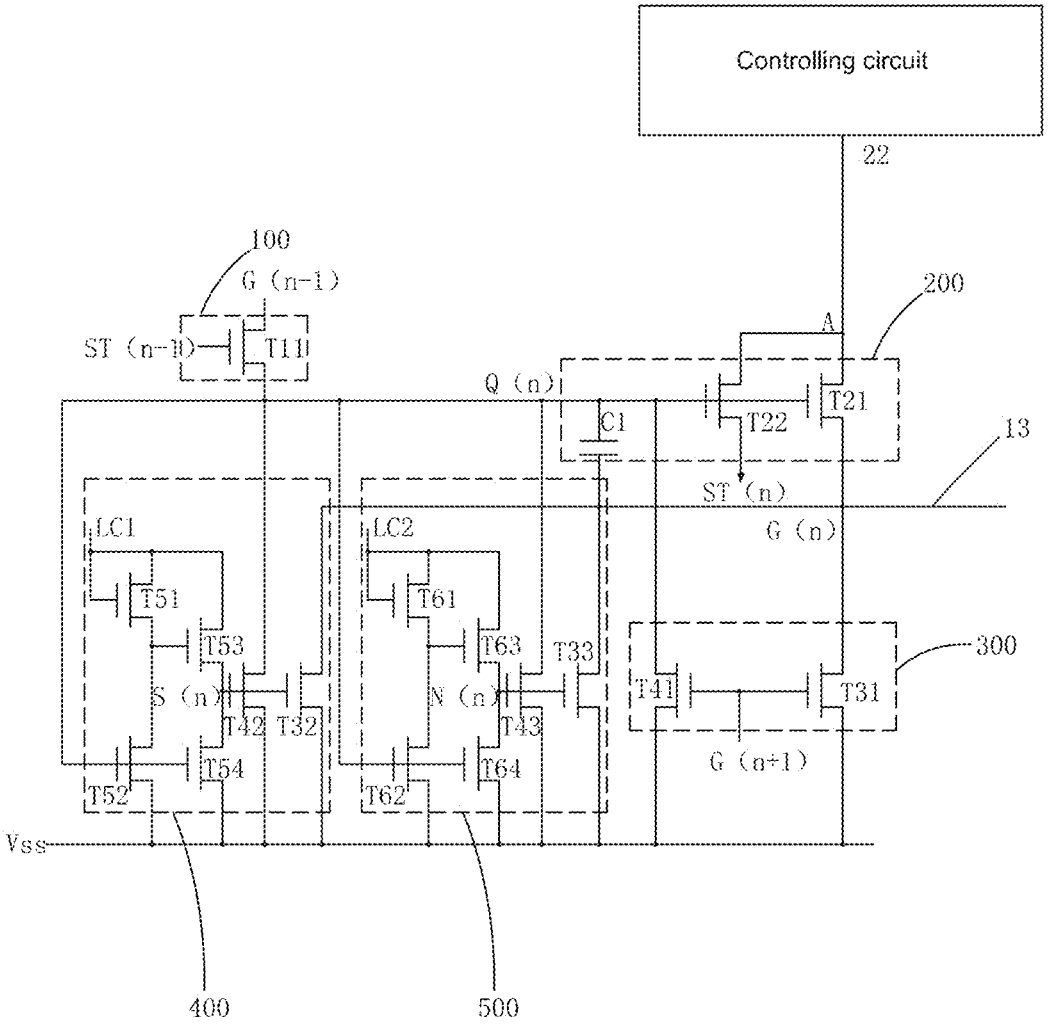
FIG. 2 is a circuit diagram of a GOA unit of nth stage in a first GOA circuit and a second GOA circuit according to one preferred embodiment of a liquid crystal display device of the present invention.
Figure 3:
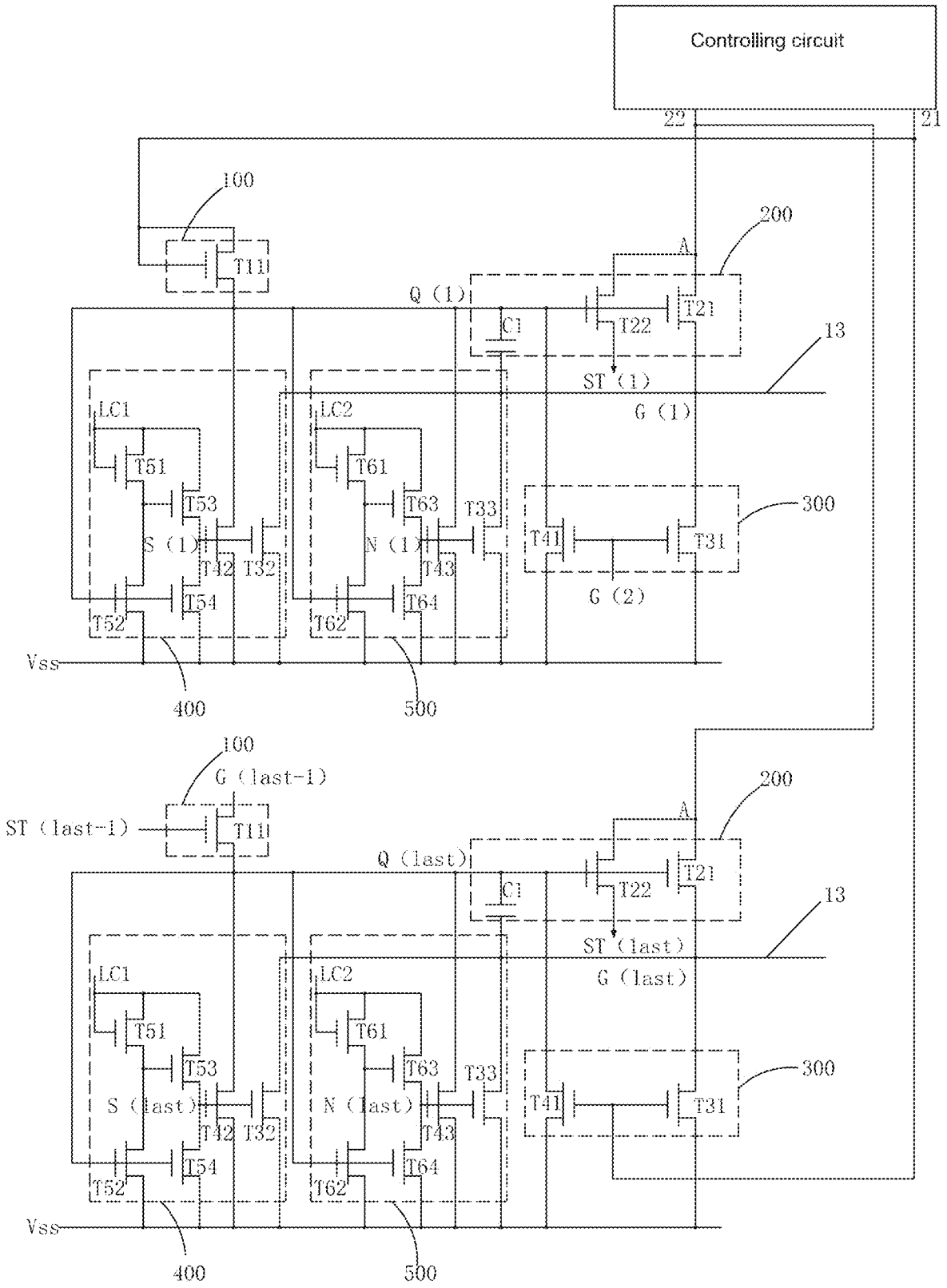
FIG. 3 is a connection circuit diagram of a GOA unit of the first stage, a GOA unit of the last stage and a controlling circuit in the first GOA circuit and the second GOA circuit according to one preferred embodiment of a liquid crystal display device of the present invention.
Figure 4:
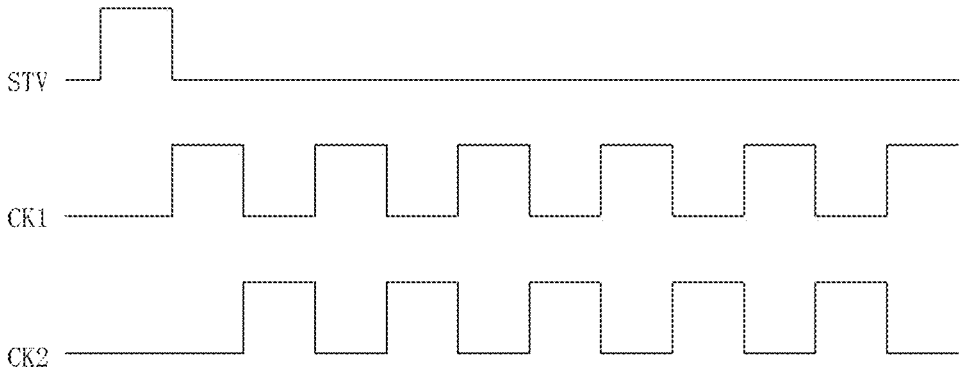
FIG. 4 is a waveform diagram of a start signal, a first clock signal and a second clock signal in one preferred embodiment of a liquid crystal display device of the present invention.

Specifically, please refer to FIG. 2 to FIG. 4. In one preferred embodiment of the present invention, the first GOA circuit 14 and the second GOA circuit 15 each comprises GOA units of a plurality of stages which are cascade coupled, and the GOA unit of each stage in the first GOA circuit 14 and the second GOA circuit 15 comprises a pull-up controlling circuit 100, a pull-up circuit 200, a pull-down circuit 300, a first pull-down maintaining circuit 400 and a second pull-down maintaining circuit 500.

Please refer to FIG. 2, n is set to be a positive integer in the GOA unit of the nth stage in the first GOA circuit 14 and the second GOA circuit 15 except for the GOA units of the first stage and the GOA units of the last stage in the first GOA circuit 14 and the second GOA circuit 15:

The pull-up controlling circuit 100 comprises a first thin film transistor T11. A gate of the first thin film transistor T11 receives a stage transfer signal ST(n−1) of the GOA unit of the n−1th stage, and a source of the first thin film transistor is electrically coupled to an output end G(n−1) of the GOA unit of the n−1th stage, and a drain of the first thin film transistor is electrically coupled to a first node Q(n).

The pull-up circuit 200 comprises a second thin film transistor T21, a third thin film transistor T22 and a capacitor C1. A gate of the second thin film transistor T21 is electrically coupled to the first node Q(n), and a source of the second thin film transistor is electrically coupled to a source of the third thin film transistor T22 and is coupled to a clock signal input end A of the GOA unit of the nth stage, and a drain of the second thin film transistor is coupled to an output end G(n) of the GOA unit of the nth stage coupled to the nth scan line 13. A gate of the third thin film transistor T22 is electrically coupled to the first node Q(n), and a drain of the third thin film transistor outputs the stage transfer signal ST(n). One end of the capacitor C1 is electrically coupled to the first node Q(n), and the other end of the capacitor is electrically coupled to the drain of the second thin film transistor T21.

The pull-down circuit 300 comprises a fourth thin film transistor T31 and a fifth thin film transistor T41. A gate of the fourth thin film transistor T31 is electrically coupled to an output end G(n+1) of the GOA unit of the n+1th stage, and a source of the fourth thin film transistor is electrically coupled to the drain of the second thin film transistor T21, and a drain of the fourth thin film transistor receives a constant low voltage level Vss. A gate of the fifth thin film transistor T41 is electrically coupled to the gate of the fourth thin film transistor, T31 and the source of the fifth thin film transistor is electrically coupled to the first node Q(n), and a drain of the fifth thin film transistor receives the constant low voltage level Vss.

The first pull-down maintaining circuit 400 comprises a sixth thin film transistor T32, a seventh thin film transistor T42, an eighth thin film transistor T51, a ninth thin film transistor T52, a tenth thin film transistor T53 and an eleventh thin film transistor T54. A gate of the sixth thin film transistor T32 is coupled to a second node S(n), and a source of the sixth thin film transistor is electrically coupled to the drain of the second thin film transistor T21, and a drain of the sixth thin film transistor receives the constant low voltage level Vss. A gate of the seventh thin film transistor T42 is electrically coupled to the second node S(n), and a source of the seventh thin film transistor is electrically coupled to the first node Q(n), and a drain of the seventh thin film transistor receives the constant low voltage level Vss. A gate and a source of the eighth thin film transistor T51 both receive a first low frequency control signal LC1, and a drain of the eighth thin film transistor is electrically coupled to a gate of the tenth thin film transistor T53. A gate of the ninth thin film transistor T52 is electrically coupled to the first node Q(n), and a source of the ninth thin film transistor is electrically coupled to the gate of the tenth thin film transistor T53, and a drain of the ninth thin film transistor receives the constant low voltage level Vss. A source of the tenth thin film transistor T53 is coupled to the first low frequency control signal LC1, and a drain of the tenth thin film transistor is electrically coupled to the second node S(n). A gate of the eleventh thin film transistor T54 is electrically coupled to the first node Q(n), and a source of the eleventh thin film transistor is electrically coupled to the second node S(n), and a drain of the eleventh thin film transistor receives the constant low voltage level Vss.

The second pull-down maintaining circuit 500 comprises a twelfth thin film transistor T33, a thirteenth thin film transistor T43, a fourteenth thin film transistor T61, a fifteenth thin film transistor T62, a sixteenth thin film transistor T63 and a seventeenth thin film transistor T64. A gate of the twelfth thin film transistor T33 is electrically coupled to a third node N(n), and a source of the twelfth thin film transistor is electrically coupled to the drain of the second thin film transistor T21, and a drain of the twelfth thin film transistor receives the constant low voltage level Vss. A gate of the thirteenth thin film transistor T43 is electrically coupled to the third node N(n), and a source of the thirteenth thin film transistor is electrically coupled to the first node Q(n), and a drain of the thirteenth thin film transistor receives the constant low voltage level Vss. A gate and a source of the fourteenth thin film transistor T61 are both receives a second low frequency control signal LC2, and a drain of the fourteenth thin film transistor is electrically coupled to a gate of the sixteenth thin film transistor T63. A gate of the fifteenth thin film transistor T62 is electrically coupled to the first node Q(n), and a source of the fifteenth thin film transistor is electrically coupled to the gate of the sixteenth thin film transistor T63, and a drain of the fifteenth thin film transistor receives the constant low voltage level Vss. A source of sixteenth thin film transistor T63 receives the second low frequency control signal LC2, and a drain of sixteenth thin film transistor is electrically coupled to the third node N(n). A gate of the seventeenth thin film transistor T64 is electrically coupled to the first node Q(n), and a source of the seventeenth thin film transistor is electrically coupled to the third node N(n), and a drain of the seventeenth thin film transistor receives the constant low voltage level Vss.

The first low frequency control signal LC1 and the second low frequency control signal LC2 are both pulse signals, and the first low frequency control signal LC1 and the second low frequency control signal LC2 both have a duty ratio of 0.5, and the first low frequency control signal LC1 and the second low frequency signal LC2 have opposite phases.

Specifically, in the preferred embodiment, the channel width of anyone of the first thin film transistor T11, the second thin film transistor T21, the third thin film transistor T22, the fourth thin film transistor T31, the fifth thin film transistor T41, the sixth thin film transistor T32, the seventh thin film transistor T42, an the eighth thin film transistor T51, the ninth thin film transistor T52, the tenth thin film transistor T53, An the eleventh thin film transistor T54, the twelfth thin film transistor T33, the thirteenth thin film transistor T43, the fourteenth thin film transistor T61, the fifteenth thin film transistor T62, the sixteenth thin film transistor T63 and the seventeenth thin film transistor T64 in the first GOA circuit 14 is greater than the channel width of anyone of the first thin film transistor T11, the second thin film transistor T21, the third thin film transistor T22, the fourth thin film transistor T31, the fifth thin film transistor T41, the sixth thin film transistor T32, the seventh thin film transistor T42, the eighth thin film transistor T51, the ninth thin film transistor T52, the tenth thin film transistor T53, the eleventh thin film transistor T54, the twelfth thin film transistor T33, the thirteenth thin film transistor T43, the fourteenth thin film transistor T61, the fifteenth thin film transistor T62, the sixteenth thin film transistor T63 and the seventeenth thin film transistor T64 in the second GOA circuit 15.

Specifically, referring to FIG. 3, in the preferred embodiment, the difference of the GOA unit of the first stage and the GOA unit of the last stage from the GOA unit of other stages in the first GOA circuit 14 is that the gate and the source of the first thin film transistor T11 of the GOA unit of the first stage in the first GOA circuit 14 are electrically coupled to the gate of the fourth thin film transistor T31 and the gate of the fifth thin film transistor T41, and the other structures are the same and are not described here. The difference of the GOA unit of the first stage and the GOA unit of the last stage from the GOA unit of other stages in the second GOA circuit 15 is that the gate and the source of the first thin film transistor T11 of the GOA unit of the first stage in the second GOA circuit 15 are electrically coupled to the gate of the fourth thin film transistor T31 and the gate of the fifth thin film transistor T41.

Specifically, in the preferred embodiment, the controlling circuit 20 has two start signal output ends 21 and four clock signal output ends 22. One of the two start signal output ends 21 of the controlling circuit 20 is electrically coupled to the gate of the first thin film transistor T11 of the first GOA unit of the first stage in the first GOA circuit 14, and the other of the two start signal output ends is electrically coupled to the gate of the first thin film transistor T11 of the GOA unit of the first stage in the second GOA circuit 15. FIG. 3 shows an electrical connection circuit diagram of one start signal output end 21 of a controlling circuit 20, a gate and a source of a first thin film transistor T11 of one GOA unit of the first stage and a gate of the fourth thin film transistor T31 and a gate of the fifth thin film transistor T41 of the GOA unit of the last stage in the first GOA circuit 14 and the second GOA circuit 15. The electrical connection of the other start signal output end 21 of a controlling circuit 20, a gate and a source of a first thin film transistor T11 of the other GOA unit of the first stage and a gate of the fourth thin film transistor T31 and a gate of the fifth thin film transistor T41 of the GOA unit of the last stage in the first GOA circuit 14 and the second GOA circuit 15 is the same and not shown. The four clock signal output ends 22 of the controlling circuit 20 are respectively electrically coupled to clock signal input ends A of the GOA units of all odd stages in the first GOA circuit 14, clock signal input ends A of the GOA units of all odd stages in the second GOA circuit 15, clock signal input ends A of the GOA units of all even stages in the first GOA circuit 14 and clock signal input ends A of the GOA units of all even stages in the second GOA circuit 15. FIG. 3 shows an electric connection diagram of the clock signal inputs A of the stage GOA unit of the first stage and the GOA unit of the last stage and a clock signal output end 22 of the control circuit 20 as one GOA unit of the last stage in the first GOA circuit 14 and the second GOA circuit 15 is a GOA unit of odd stage. Certainly, the clock signal input ends A of the GOA unit of the last stage and the corresponding clock signal input end A of the GOA unit of the first stage receives the different clock signal ends 21 of the controlling circuit 20 as one GOA unit of the last stage in the first GOA circuit 14 and the second GOA circuit 15 is a GOA unit of odd stage.

Specifically, in the preferred embodiment, the clock signal comprises a first clock signal CK1 and a second clock signal CK2. Please refer to FIG. 4. The first clock signal CK1 and the second clock signal CK2 are both pulse signals, and first clock signal CK1 and the second clock signal CK2 both have a duty ratio of 0.5, and the first clock signal CK1 and the second clock signal CK2 have opposite phases. The start signal STV has a pulse. The falling edge of the pulse coincides with the first rising edge of the first clock signal CK1.

Furthermore, in the preferred embodiment, as the ambient temperature of the liquid crystal display device is greater than or equal to the first temperature, the start signal output end 21 of the controlling circuit 20 electrically coupled to the gate of the first thin film transistor T11 of the GOA unit of the first stage in the second GOA circuit 15 outputs the start signal STV, and the clock signal output end 22 of the controlling circuit 20 electrically coupled to the clock signal input ends A of GOA units of all odd stages in the second GOA circuit 15 outputs the first clock signal CK1, and the clock signal output end 22 of the controlling circuit 20 electrically coupled to the clock signal input ends A of GOA units of all even stages in the second GOA circuit 15 outputs the second clock signal CK2 to control the second GOA circuit 15 to output the scan signal to the plurality of scan lines 13. As the ambient temperature of the liquid crystal display device is less than or equal to the second temperature, the start signal output end 21 of the controlling circuit 20 electrically coupled to the gate of the first thin film transistor T11 of the GOA unit of the first stage in the first GOA circuit 14 outputs the start signal STV, and the clock signal output end 22 of the controlling circuit 20 electrically coupled to the clock signal input ends A of GOA units of all odd stages in the first GOA circuit 14 outputs the first clock signal CK1, and the clock signal output end 22 of the controlling circuit 20 electrically coupled to the clock signal input ends A of GOA units of all even stages in the first GOA circuit 14 outputs the second clock signal CK2 to control the first GOA circuit 14 to output the scan signal to the plurality of scan lines 13. As the ambient temperature of the liquid crystal display device is less than the first temperature and greater than the second temperature, the start signal output end 21 of the controlling circuit 20 electrically coupled to the gate of the first thin film transistor T11 of the GOA unit of the first stage in the second GOA circuit 15 outputs the start signal STV, and the clock signal output end 22 of the controlling circuit 20 electrically coupled to the clock signal input ends A of GOA units of all odd stages in the second GOA circuit 15 outputs the first clock signal CK1, and the clock signal output end 22 of the controlling circuit 20 electrically coupled to the clock signal input ends A of GOA units of all even stages in the second GOA circuit 15 outputs the second clock signal CK2; the start signal output end 21 of the controlling circuit 20 electrically coupled to the gate of the first thin film transistor T11 of the GOA unit of the first stage in the first GOA circuit 14 outputs the start signal STV, and the clock signal output end 22 of the controlling circuit 20 electrically coupled to the clock signal input ends A of GOA units of all odd stages in the first GOA circuit outputs the first clock signal CK1, and the clock signal output end 22 of the controlling circuit 20 electrically coupled to the clock signal input ends A of GOA units of all even stages in the first GOA circuit 14 outputs the second clock signal CK2 to control the first GOA circuit 14 and the second GOA circuit 15 to output the scan signals to the plurality of scan lines 13 at the same time.

Figure 5:
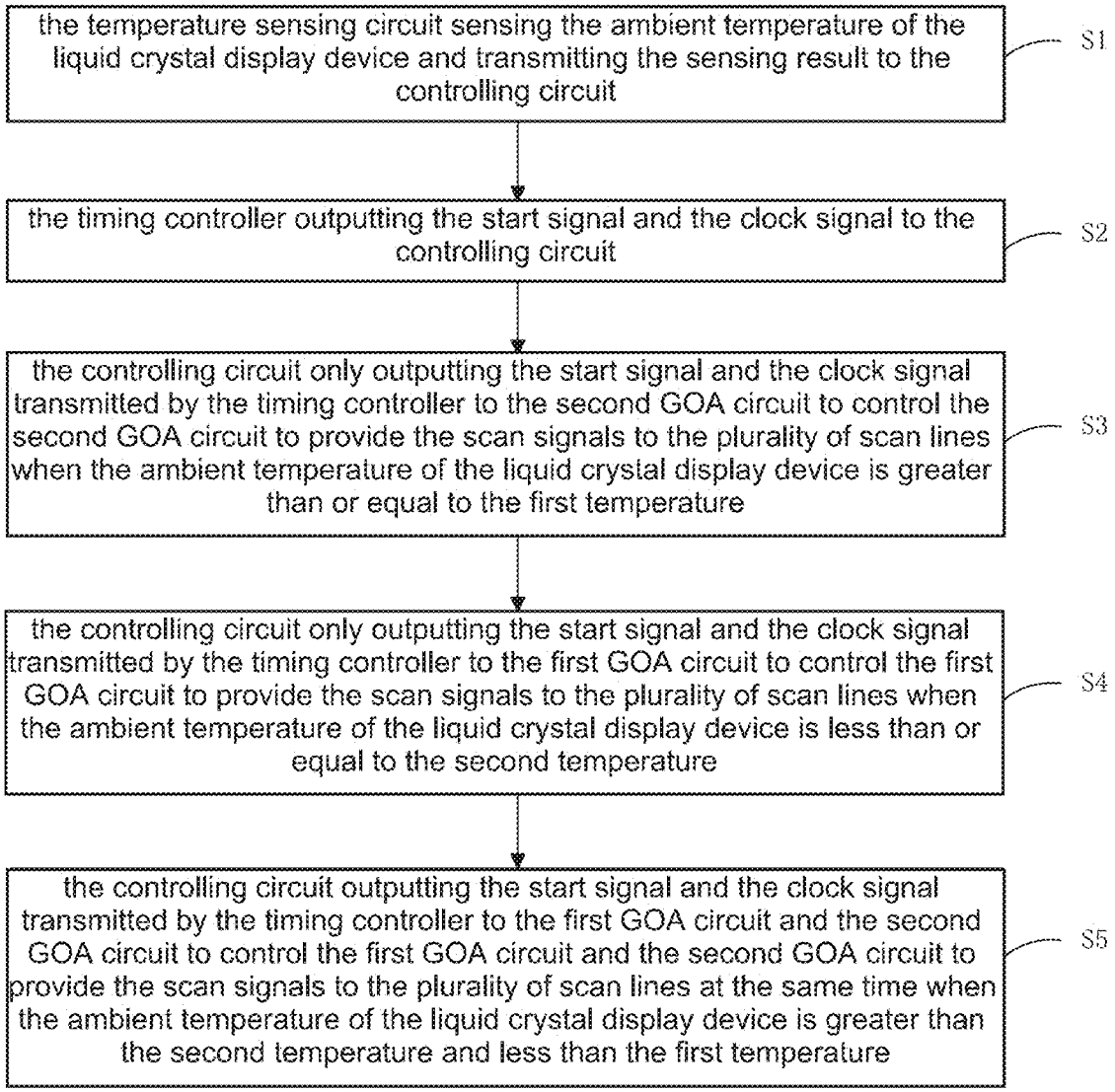
FIG. 5 is a flowchart of a driving method of a liquid crystal display device of the present invention.

Referring to FIG. 5, based on the same inventive concept, the present invention further provides a driving method of a liquid crystal display device, which is applied to the aforesaid liquid crystal display device. The structure of the liquid crystal display device will not be repeatedly described herein. The driving method of the liquid crystal display device comprises:

Step S1, the temperature sensing circuit 30 sensing the ambient temperature of the liquid crystal display device and transmitting the sensing result to the controlling circuit 20.

Step S2, the timing controller 40 outputting the start signal STV and the clock signal to the controlling circuit 20.

Step S3, the controlling circuit 20 only outputting the start signal STV and the clock signal transmitted by the timing controller 40 to the second GOA circuit 15 to control the second GOA circuit 15 to provide the scan signals to the plurality of scan lines 13 when the ambient temperature of the liquid crystal display device is greater than or equal to the first temperature.

Step S4, the controlling circuit 20 only outputting the start signal STV and the clock signal transmitted by the timing controller 40 to the first GOA circuit 14 to control the first GOA circuit 14 to provide the scan signals to the plurality of scan lines 13 when the ambient temperature of the liquid crystal display device is less than or equal to the second temperature.

Step S4, the controlling circuit 20 only outputting the start signal STV and the clock signal transmitted by the timing controller 40 to the first GOA circuit 14 to control the first GOA circuit 14 to provide the scan signals to the plurality of scan lines 13 when the ambient temperature of the liquid crystal display device is less than or equal to the second temperature.

During operation, the temperature sensing circuit 30 is used to sense the ambient temperature of the liquid crystal display device. When the ambient temperature is greater than the first temperature, it indicates that the liquid crystal display device needs to enter a high temperature operation mode at this time, and the leakage current needs to be reduced. Then, the controlling circuit 20 only outputs the start signal STV and the clock signal to the second GOA circuit 15 to control the second GOA circuit 15 to provide the scan signals to the plurality of scan lines 13, and the first GOA circuit 14 does not work. Since the channel width of the thin film transistors in the second GOA circuit 15 is less than the channel width of the thin film transistors in the first GOA circuit 14, by designing the first temperature and the channel width of the thin film transistors in the second GOA circuit 15, the leakage current of the thin film transistors in the second GOA circuit 15 can be prevented at this time, so as to ensure that the output of the second GOA circuit 15 is normal. When the ambient temperature of the liquid crystal display device is less than the second temperature, it indicates that the liquid crystal display device needs to enter a low temperature operation mode at this time, and the driving ability is required to be enhanced. Then, the controlling circuit 20 only outputs the start signal STV and the clock signal to the first GOA circuit 14 to control the first GOA circuit 14 to provide the scan signals to the plurality of scan lines 13, and the second GOA circuit 15 does not work. Since the channel width of the thin film transistors in the first GOA circuit 14 is less than the channel width of the thin film transistors in the second GOA circuit 15, by designing the second temperature and the channel width of the thin film transistors in the first GOA circuit 14, the driving ability of the thin film transistors in the first GOA circuit 14 can be enhanced at this time. When the ambient temperature of the liquid crystal display device is less than the first temperature and greater than the second temperature, it indicates that the ambient temperature of the liquid crystal display device is normal. Then, the controlling circuit 20 only outputs the start signal STV and the clock signal to the first GOA circuit 14 and the second GOA circuit 15 to control the first GOA circuit 14 and the second GOA circuit 15 to provide the scan signals to the plurality of scan lines 13 at the same time for implementing the double side driving to the plurality of scan lines 13. The aforesaid driving method of the liquid crystal display device is capable of expanding the operating temperature range and effectively promoting product quality.

In conclusion, the first GOA circuit and the second GOA circuit are disposed on the liquid crystal panel in the liquid crystal display device provided by the present invention, and the channel widths of the thin film transistors in the first GOA circuit are greater than the channel widths of the thin film transistors in the second GOA circuit. During operation, when the ambient temperature is too high, the controlling circuit only outputs the start signal and the clock signal to the second GOA circuit to control the second GOA circuit to provide the scan signals to the plurality of scan lines. When the ambient temperature is too low, the controlling circuit only outputs the start signal and the clock signal to the first GOA circuit to control the first GOA circuit to provide the scan signals to the plurality of scan lines. When the ambient temperature is normal, the controlling circuit outputs the start signal and the clock signal to the first GOA circuit and the second GOA circuit to control the first GOA circuit and the second GOA circuit provide the scan signals to the plurality of scan lines at the same time, thereby effectively increasing the operating temperature range of the liquid crystal display device and improving the product quality. The driving method of the liquid crystal display device according to the present invention is capable of expanding an operating temperature range and promoting product quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A liquid crystal display device, comprising a liquid crystal panel, a controlling circuit electrically coupled to the liquid crystal panel, a temperature sensing circuit electrically coupled to the controlling circuit and a timing controller electrically coupled to the controlling circuit;

wherein the liquid crystal panel comprises a plurality of sub pixels arranged in an array, a plurality of scan lines respectively coupled to a plurality of rows of sub pixels, and a first GOA (gate driver on array) circuit and a second GOA (gate driver on array) circuit respectively disposed on both sides of the sub pixels in an array; one end of each scan line is electrically coupled to the first GOA circuit, and the other end is electrically coupled to the second GOA circuit; each of the first GOA circuit and the second GOA circuit comprises a plurality of thin film transistors, and a channel width of the thin film transistors in the first GOA circuit is greater than a channel width of the thin film transistors in the second GOA circuit;

the temperature sensing circuit is used to sense an ambient temperature of the liquid crystal display device and transmit a sensing result to the controlling circuit;

the timing controller is used to output a start signal and a clock signal to the controlling circuit;

a first temperature and a second temperature is predetermined, and the first temperature is higher than the second temperature, and the controlling circuit is used to only output the start signal and the clock signal transmitted by the timing controller to the second GOA circuit to control the second GOA circuit to provide scan signals to the plurality of scan lines when the ambient temperature of the liquid crystal display device is greater than or equal to the first temperature, and to only output the start signal and the clock signal transmitted by the timing controller to the first GOA circuit to control the first GOA circuit to provide scan signals to the plurality of scan lines when the ambient temperature of the liquid crystal display device is less than or equal to the second temperature, and to output the start signal and the clock signal transmitted by the timing controller to the first GOA circuit and the second GOA circuit to control the first GOA circuit and the second GOA circuit to provide scan signals to the plurality of scan lines at the same time when the ambient temperature of the liquid crystal display device is greater than the second temperature and less than the first temperature.

2. The liquid crystal display device according to claim 1, wherein the first GOA circuit and the second GOA circuit each comprises GOA units of a plurality of stages which are cascade coupled, and the GOA unit of each stage in the first GOA circuit and the second GOA circuit comprises a pull-up controlling circuit, a pull-up circuit, a pull-down circuit, first pull-down maintaining circuit and a second pull-down maintaining circuit;

n is set to be a positive integer in the GOA unit of the nth stage in the first GOA circuit and the second GOA circuit except for the GOA units of the first stage and the GOA units of the last stage in the first GOA circuit and the second GOA circuit;

the pull-up controlling circuit comprises a first thin film transistor; a gate of the first thin film transistor receives a stage transfer signal of the GOA unit of the n−1th stage, and a source of the first thin film transistor is electrically coupled to an output end of the GOA unit of the n−1th stage, and a drain of the first thin film transistor is electrically coupled to a first node;

the pull-up circuit comprises a second thin film transistor, a third thin film transistor and a capacitor; a gate of the second thin film transistor is electrically coupled to the first node, and a source of the second thin film transistor is electrically coupled to a source of the third thin film transistor and is coupled to a clock signal input end of the GOA unit of the nth stage, and a drain of the second thin film transistor is coupled to an output end of the GOA unit of the nth stage coupled to the nth scan line; a gate of the third thin film transistor is electrically coupled to the first node, and a drain of the third thin film transistor outputs the stage transfer signal; one end of the capacitor is electrically coupled to the first node, and the other end of the capacitor is electrically coupled to the drain of the second thin film transistor;

the pull-down circuit comprises a fourth thin film transistor and a fifth thin film transistor; a gate of the fourth thin film transistor is electrically coupled to an output end of the GOA unit of the n+1th stage, and a source of the fourth thin film transistor is electrically coupled to the drain of the second thin film transistor, and a drain of the fourth thin film transistor receives a constant low voltage level; a gate of the fifth thin film transistor is electrically coupled to the gate of the fourth thin film transistor, and the source of the fifth thin film transistor is electrically coupled to the first node, and a drain of the fifth thin film transistor receives the constant low voltage level;

the first pull-down maintaining circuit comprises a sixth thin film transistor, a seventh thin film transistor, an eighth thin film transistor, a ninth thin film transistor, a tenth thin film transistor and an eleventh thin film transistor; a gate of the sixth thin film transistor is coupled to a second node, and a source of the sixth thin film transistor is electrically coupled to the drain of the second thin film transistor, and a drain of the sixth thin film transistor receives the constant low voltage level; a gate of the seventh thin film transistor is electrically coupled to the second node, and a source of the seventh thin film transistor is electrically coupled to the first node, and a drain of the seventh thin film transistor receives the constant low voltage level; a gate and a source of the eighth thin film transistor both receive a first low frequency control signal, and a drain of the eighth thin film transistor is electrically coupled to a gate of the tenth thin film transistor; a gate of the ninth thin film transistor is electrically coupled to the first node, and a source of the ninth thin film transistor is electrically coupled to the gate of the tenth thin film transistor, and a drain of the ninth thin film transistor receives the constant low voltage level; a source of the tenth thin film transistor receives the first low frequency control signal, and a drain of the tenth thin film transistor is electrically coupled to the second node; a gate of the eleventh thin film transistor is electrically coupled to the first node, and a source of the eleventh thin film transistor is electrically coupled to the second node, and a drain of the eleventh thin film transistor receives the constant low voltage level;

the second pull-down maintaining circuit comprises a twelfth thin film transistor, a thirteenth thin film transistor, a fourteenth thin film transistor, a fifteenth thin film transistor, a sixteenth thin film transistor and a seventeenth thin film transistor; a gate of the twelfth thin film transistor is electrically coupled to a third node, and a source of the twelfth thin film transistor is electrically coupled to the drain of the second thin film transistor, and a drain of the twelfth thin film transistor receives the constant low voltage level; a gate of the thirteenth thin film transistor is electrically coupled to the third node, and a source of the thirteenth thin film transistor is electrically coupled to the first node, and a drain of the thirteenth thin film transistor receives the constant low voltage level; a gate and a source of the fourteenth thin film transistor are both receive a second low frequency control signal, and a drain of the fourteenth thin film transistor is electrically coupled to a gate of the sixteenth thin film transistor; a gate of the fifteenth thin film transistor is electrically coupled to the first node, and a source of the fifteenth thin film transistor is electrically coupled to the gate of the sixteenth thin film transistor, and a drain of the fifteenth thin film transistor receives the constant low voltage level; a source of sixteenth thin film transistor receives the second low frequency control signal, and a drain of sixteenth thin film transistor is electrically coupled to the third node; a gate of the seventeenth thin film transistor is electrically coupled to the first node, and a source of the seventeenth thin film transistor is electrically coupled to the third node, and a drain of the seventeenth thin film transistor receives the constant low voltage level;

the first low frequency control signal and the second low frequency control signal are both pulse signals, and the first low frequency control signal and the second low frequency control signal both have a duty ratio of 0.5, and the first low frequency control signal and the second low frequency signal have opposite phases;

a gate and a source of a first thin film transistor of the GOA unit of the first stage are electrically coupled to a gate of the fourth thin film transistor and a gate of the fifth thin film transistor of the GOA unit of the last stage in the first GOA circuit;

a gate and a source of a first thin film transistor of the GOA unit of the first stage are electrically coupled to a gate of the fourth thin film transistor and a gate of the fifth thin film transistor of the GOA unit of the last stage in the second GOA circuit;

the controlling circuit has two start signal output ends and four clock signal output ends; one of the two start signal output ends of the controlling circuit is electrically coupled to the gate of the first thin film transistor of the first GOA unit of the first stage in the first GOA circuit, and the other of the two start signal output ends is electrically coupled to the gate of the first thin film transistor of the GOA unit of the first stage in the second GOA circuit; the four clock signal output ends of the control circuit are respectively electrically coupled to clock signal input ends of the GOA units of all odd stages in the first GOA circuit, clock signal input ends of the GOA units of all odd stages in the second GOA circuit, clock signal input ends of the GOA units of all even stages in the first GOA circuit and clock signal input ends of the GOA units of all even stages in the second GOA circuit.

3. The liquid crystal display device according to claim 2, wherein the clock signal comprises a first clock signal and a second clock signal; the first clock signal and the second clock signal are both pulse signals, and the first clock signal and the second clock signal both have a duty ratio of 0.5, and the first clock signal and the second clock signal have opposite phases.

4. The liquid crystal display device according to claim 3, wherein as the ambient temperature of the liquid crystal display device is greater than or equal to the first temperature, the start signal output end of the controlling circuit electrically coupled to the gate of the first thin film transistor of the GOA unit of the first stage in the second GOA circuit outputs the start signal, and the clock signal output end of the controlling circuit electrically coupled to the clock signal input ends of GOA units of all odd stages in the second GOA circuit outputs the first clock signal, and the clock signal output end of the controlling circuit electrically coupled to the clock signal input ends of GOA units of all even stages in the second GOA circuit outputs the second clock signal to control the second GOA circuit to output the scan signal to the plurality of scan lines;

as the ambient temperature of the liquid crystal display device is less than or equal to the second temperature, the start signal output end of the controlling circuit electrically coupled to the gate of the first thin film transistor of the GOA unit of the first stage in the first GOA circuit outputs the start signal, and the clock signal output end of the controlling circuit electrically coupled to the clock signal input ends of GOA units of all odd stages in the first GOA circuit outputs the first clock signal, and the clock signal output end of the controlling circuit electrically coupled to the clock signal input ends of GOA units of all even stages in the first GOA circuit outputs the second clock signal to control the first GOA circuit to output the scan signal to the plurality of scan lines;

as the ambient temperature of the liquid crystal display device is less than the first temperature and greater than the second temperature, the start signal output end of the controlling circuit electrically coupled to the gate of the first thin film transistor of the GOA unit of the first stage in the second GOA circuit outputs the start signal, and the clock signal output end of the controlling circuit electrically coupled to the clock signal input ends of GOA units of all odd stages in the second GOA circuit outputs the first clock signal, and the clock signal output end of the controlling circuit electrically coupled to the clock signal input ends of GOA units of all even stages in the second GOA circuit outputs the second clock signal; the start signal output end of the controlling circuit electrically coupled to the gate of the first thin film transistor of the GOA unit of the first stage in the first GOA circuit outputs the start signal, and the clock signal output end of the controlling circuit electrically coupled to the clock signal input ends of GOA units of all odd stages in the first GOA circuit outputs the first clock signal, and the clock signal output end of the controlling circuit electrically coupled to the clock signal input ends of GOA units of all even stages in the first GOA circuit outputs the second clock signal to control the first GOA circuit and the second GOA circuit to output the scan signals to the plurality of scan lines.

5. The liquid crystal display device according to claim 2, wherein the channel width of anyone of the first thin film transistor, the second thin film transistor the third thin film transistor, the fourth thin film transistor, the fifth thin film transistor, the sixth thin film transistor, the seventh thin film transistor, the eighth thin film transistor, the ninth thin film transistor, the tenth thin film transistor, the eleventh thin film transistor, the twelfth thin film transistor, the thirteenth thin film transistor, the fourteenth thin film transistor, the fifteenth thin film transistor, the sixteenth thin film transistor and the seventeenth thin film transistor in the first GOA circuit is greater than the channel width of anyone of the first thin film transistor, the second thin film transistor, the third thin film transistor, the fourth thin film transistor, the fifth thin film transistor, the sixth thin film transistor, the seventh thin film transistor, the eighth thin film transistor, the ninth thin film transistor, the tenth thin film transistor, An eleventh thin film transistor, the twelfth thin film transistor, the thirteenth thin film transistor, the fourteenth thin film transistor, the fifteenth thin film transistor, the sixteenth thin film transistor and the seventeenth thin film transistor in the second GOA circuit.

6. The liquid crystal display device according to claim 1, wherein the first temperature is 75 degrees Celsius to 85 degrees Celsius; the second temperature is −35 degrees Celsius to −45 degrees Celsius.

7. The liquid crystal display device according to claim 1, wherein the liquid crystal panel further comprises a plurality of data lines respectively coupled to the plurality of columns of sub pixels.

8. The liquid crystal display device according to claim 1, wherein the liquid crystal panel comprises a display area and a border area outside the display area;

the plurality of sub pixels are all disposed in the display area, and the first GOA circuit and the second GOA circuit are both disposed in the border area.

9. The liquid crystal display device according to claim 1, wherein the temperature sensing circuit is a temperature sensor.

10. A driving method, applied to the liquid crystal display device according to claim 1, comprising:

the temperature sensing circuit sensing the ambient temperature of the liquid crystal display device and transmitting the sensing result to the controlling circuit;

the timing controller outputting the start signal and the clock signal to the controlling circuit;

the controlling circuit only outputting the start signal and the clock signal transmitted by the timing controller to the second GOA circuit to control the second GOA circuit to provide the scan signals to the plurality of scan lines when the ambient temperature of the liquid crystal display device is greater than or equal to the first temperature;

the controlling circuit only outputting the start signal and the clock signal transmitted by the timing controller to the first GOA circuit to control the first GOA circuit to provide the scan signals to the plurality of scan lines when the ambient temperature of the liquid crystal display device is less than or equal to the second temperature;

the controlling circuit outputting the start signal and the clock signal transmitted by the timing controller to the first GOA circuit and the second GOA circuit to control the first GOA circuit and the second GOA circuit to provide the scan signals to the plurality of scan lines at the same time when the ambient temperature of the liquid crystal display device is greater than the second temperature and less than the first temperature.

* * * * *